US010824087B2

(12) United States Patent
Kinuta et al.

(10) Patent No.: US 10,824,087 B2
(45) Date of Patent: Nov. 3, 2020

(54) CHARGING MEMBER, CHARGING DEVICE, PROCESS CARTRIDGE, AND IMAGE FORMING APPARATUS

(71) Applicant: FUJI XEROX CO., LTD., Tokyo (JP)

(72) Inventors: Yasuhiko Kinuta, Kanagawa (JP); Shogo Tomari, Kanagawa (JP); Hiroko Kobayashi, Kanagawa (JP); Kosuke Narita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/518,178

(22) Filed: Jul. 22, 2019

(65) Prior Publication Data

US 2020/0301306 A1 Sep. 24, 2020

(30) Foreign Application Priority Data

Mar. 20, 2019 (JP) ..... 2019-052981

(51) Int. Cl.
*G03G 15/02* (2006.01)
*G03G 21/18* (2006.01)

(52) U.S. Cl.
CPC ..... *G03G 15/0233* (2013.01); *G03G 15/0225* (2013.01); *G03G 21/1835* (2013.01)

(58) Field of Classification Search
CPC ..... G03G 15/0233; G03G 15/0225; G03G 21/1835; G03G 2215/021
See application file for complete search history.

(56) References Cited

U.S. PATENT DOCUMENTS

| | | | | |
|---|---|---|---|---|
| 7,706,713 | B2 | 4/2010 | Terai et al. | |
| 2008/0124131 | A1* | 5/2008 | Higaki | G03G 15/0225 399/176 |
| 2018/0024460 | A1* | 1/2018 | Uematsu | G03G 15/0233 399/176 |
| 2018/0275551 | A1* | 9/2018 | Kuroda | G03G 15/0233 |
| 2019/0064726 | A1* | 2/2019 | Katagiri | G03G 15/0233 |

FOREIGN PATENT DOCUMENTS

| | | | |
|---|---|---|---|
| JP | 2007-127849 | A | 5/2007 |
| JP | 2011-13462 | A | 1/2011 |
| JP | 2011-95725 | A | 5/2011 |

* cited by examiner

*Primary Examiner* — Sophia S Chen
(74) *Attorney, Agent, or Firm* — Sughrue Mion, PLLC

(57) ABSTRACT

A charging member includes a conductive substrate, an elastic layer disposed on the conductive substrate, and a surface layer disposed on the elastic layer. Regarding the surface of the surface layer, in the axial direction, the ratio of the mean spacing of profile irregularities Sm to the ten-point mean roughness Rz and the reduced peak height Spk respectively satisfy 15≤Sm/Rz≤35 and Spk≤5 μm.

10 Claims, 5 Drawing Sheets

CHARGING MEMBER, CHARGING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2019-052981 filed Mar. 20, 2019.

BACKGROUND

(i) Technical Field

The present disclosure relates to a charging member, a charging device, a process cartridge, and an image forming apparatus.

(ii) Related Art

As a charging member included in an electrophotographic image forming apparatus, a charging member including at least an elastic layer on a conductive substrate, specifically the following charging member, is known.

Japanese Unexamined Patent Application Publication No. 2011-095725 discloses a charging roller including at least one conductive rubber elastic layer on the outer surface of the metal core. The charging roller has a microhardness of 48° to 60°. Regarding the surface state of the charging roller, the ten-point mean roughness Rz1 of the charging roller in the axial direction, the ten-point mean roughness Rz2 of the charging roller in the circumferential direction, the mean spacing of profile irregularities Sm1 of the charging roller in the axial direction, and the mean spacing of profile irregularities Sm2 of the charging roller in the circumferential direction satisfy the following formulas: $1.00<Rz1/Rz2\leq 2.00$, $0<Sm1/Sm2\leq 1.00$, $11\ \mu m<Rz1$.

SUMMARY

Some charging members may cause the generation of image streaks due to the transfer of contaminants on the photoconductor to the charging member. Some charging members may wear the surface of the electrophotographic photoconductor.

Aspects of non-limiting embodiments of the present disclosure relate to providing a charging member including a conductive substrate, an elastic layer disposed on the conductive substrate, and a surface layer disposed on the elastic layer. The charging member suppresses the generation of image streaks and the wear of the electrophotographic photoconductor surface, compared with a case in which the ratio of the mean spacing of profile irregularities Sm to the ten-point mean roughness Rz (Sm/Rz) in the axial direction is less than 15 or more than 35 or a case in which the reduced peak height Spk in the axial direction is more than 5 μm.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

The specific way to address the above problems includes the following aspect.

According to an aspect of the present disclosure, there is provided a charging member including a conductive substrate, an elastic layer disposed on the conductive substrate, and a surface layer disposed on the elastic layer. Regarding the surface of the surface layer, in the axial direction, the ratio of the mean spacing of profile irregularities Sm to the ten-point mean roughness Rz and the reduced peak height Spk respectively satisfy $15\leq Sm/Rz\leq 35$ and $Spk\leq 5$ μm.

BRIEF DESCRIPTION OF THE DRAWINGS

An exemplary embodiment of the present disclosure will be described in detail based on the following figures, wherein.

DETAILED DESCRIPTION

Figure 1:
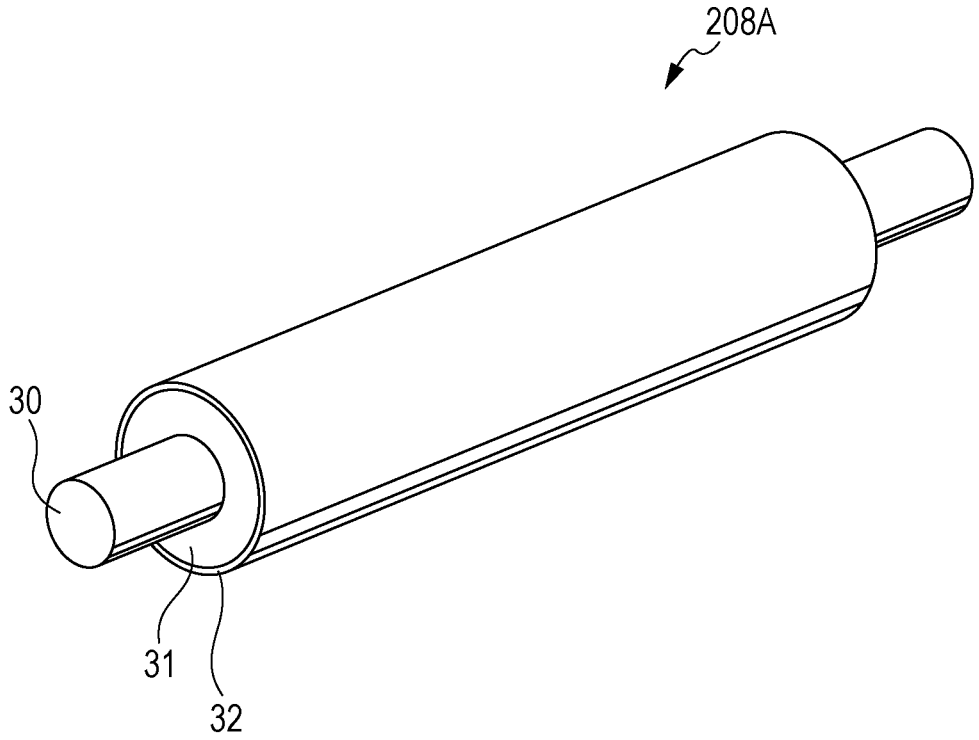
FIG. 1 is a schematic diagram of an exemplary charging member according to the exemplary embodiment.

Hereinafter, the exemplary embodiment of the present disclosure will be described. The following description and examples show the exemplary embodiment, and the scope of the present disclosure is not limited thereto.

In the present specification, in a case in which the amount of constituent in a composition is stated, when there are two or more substances corresponding to a single constituent in the composition, the amount of such a constituent in the composition refers to the total amount of the two or more substances in the composition, unless stated otherwise.

In the present specification, "electrophotographic photoconductor" is also stated as "photoconductor".

In the present specification, the axial direction of the charging member refers to a direction in which the rotation axis of the charging member extends. "Circumferential direction" refers to a direction in which the charging member rotates.

In the present specification, "conductive" means that the volume resistivity is $1\times 10^{14}$ Ωcm or lower at 20° C.

Charging Member

A charging member according to the exemplary embodiment includes a conductive substrate, an elastic layer disposed on the conductive substrate, and a surface layer disposed on the elastic layer.

Regarding the surface of the surface layer, the ratio of the mean spacing of profile irregularities Sm to the ten-point mean roughness Rz in the axial direction and the reduced peak height Spk respectively satisfy $15\leq Sm/Rz\leq 35$ and $Spk\leq 5$ μm.

In the field of electrophotographic technology, there is currently a demand for small and low-cost electrophotographic apparatuses, and thus, a contact charging method is commonly used for charging. For example, the surface of the contact charging-type charging member may be contaminated with toner particles or external additives. The contamination, with toner particles or external additives, of the contact charging-type charging member occurs due to toner particles or external additives that are not completely removed by cleaning in a photoconductor cleaning portion and that remain at a contact portion between the photoconductor and the charging member. In other words, the contamination occurs due to "escape" of toner particles or external additives. It is known that a cleaning member for a charging member, for example, is used to remove contaminants on the charging member. Contaminants that have been present on the photoconductor are transferred to the charging member at a contact portion between the photoconductor and the charging member.

A charging member including, for example, a conductive substrate, an elastic layer disposed on the conductive substrate, and a surface layer disposed on the elastic layer is known. In such a charging member, regarding the surface of the surface layer, an excessively low ratio of the mean spacing of profile irregularities Sm to the ten-point mean roughness Rz (Sm/Rz) in the axial direction makes it difficult to remove contaminants attached to the charging member by using a cleaning member for the charging member. Thus, contaminants are likely to deposit on the surface of the charging member, and image streaks are likely to be generated. An excessively high Sm/Rz enlarges the contact region between the photoconductor and the charging member. Thus, contaminants that have been already present on the photoconductor are likely to transfer to the charging member, and image streaks are likely to be generated.

An excessively high reduced peak height Spk causes discharge at the contact portion between the photoconductor and the charging member in addition to a portion (i.e., pre-nip portion) upstream in the rotation direction from the contact portion between the photoconductor and the charging member and a portion (i.e., post-nip portion) downstream in the rotation direction from the contact portion between the photoconductor and the charging member. Thus, due to the discharge stress, the surface of the photoconductor is likely to be worn. The surface of a photoconductor including a photosensitive layer containing an organic material is particularly worn.

On the other hand, the charging member according to the exemplary embodiment has the above features and thus suppresses the generation of image streaks and the wear of the electrophotographic photoconductor surface. The reason for this is not sufficiently clarified, but is presumed as follows.

In the charging member according to the exemplary embodiment, regarding the surface of the surface layer, Sm/Rz in the axial direction is 15 or higher and 35 or lower. Thus, contaminants remaining on the photoconductor are unlikely to transfer, and even if contaminants transfer, the contaminants may be easily removed. Regarding the surface of the surface layer, the reduced peak height Spk in the axial direction is 5 μm or less. Thus, discharge at the contact portion between the photoconductor and the charging member is suppressed, thereby suppressing the discharge stress of the photoconductor surface. As a result, it is considered that the generation of image streaks are suppressed as well as the wear of the electrophotographic photoconductor surface.

Hereinafter, the charging member according to the exemplary embodiment will be fully described.

The charging member according to the exemplary embodiment may have any shape, such as a roller, a brush, a belt (tube), or a blade. Among such shapes, a roller-type charging member illustrated in FIG. 1, in other words, a charging roller, is preferred.

FIG. 1 is a view of an exemplary charging member according to the exemplary embodiment. A charging member 208A illustrated in FIG. 1 includes a conductive substrate 30, which is a hollow or non-hollow cylindrical member, an elastic layer 31 disposed on the outer circumferential surface of the conductive substrate 30, and a surface layer 32 disposed on the outer circumferential surface of the elastic layer 31.

In the charging member according to the exemplary embodiment, regarding the surface of the surface layer, the ratio of the mean spacing of profile irregularities Sm to the ten-point mean roughness Rz (Sm/Rz) in the axial direction satisfies $15 \leq Sm/Rz \leq 35$. From the viewpoint of suppressing the generation of image streaks, Sm/Rz preferably satisfies $20 \leq Sm/Rz \leq 30$. In the charging member according to the exemplary embodiment, regarding the surface of the surface layer, the reduced peak height Spk in the axial direction satisfies Spk≤5 μm. From the viewpoint of suppressing the wear of the electrophotographic photoconductor surface, the reduced peak height Spk may be small. From such a viewpoint, the reduced peak height Spk preferably satisfies Spk≤4 μm and more preferably Spk≤3.5 μm. The lower limit of Spk may be 2 μm or higher (i.e., Spk may satisfy 2 μm≤Spk≤5 μm). The lower limit of Spk is 2 μm or higher, so that the generation of image streaks is suppressed and that a charging member that suppresses the wear of an electrophotographic photoconductor surface is likely to be obtained.

From the viewpoint of suppressing the generation of image streaks, the mean spacing of profile irregularities Sm in the axial direction is preferably 50 μm or more and 250 μm or less and more preferably 80 μm or more and 200 μm or less.

From the viewpoint of suppressing the generation of image streaks, the ten-point mean roughness Rz in the axial direction is preferably 3 μm or more and 15 μm or less and more preferably 4 μm or more and 10 μm or less.

The ten-point mean roughness Rz is measured in conformity with JIS B 0601:1994. The ten-point mean roughness Rz is measured in an environment of 23° C. and 55% RH by using a contact-type surface roughness tester (SURFCOM 570A, manufactured by Tokyo Seimitsu Co., Ltd.). The measurement distance is 2.5 mm. The measurement is performed by using a contact needle having a tip made of diamond (5 μmR, 90° cone). The measurement values are averaged. The ten-point mean roughness Rz in the axial direction may be an average value determined by dividing a charging member into six equal parts in the axial direction, performing measurement in the center portion of each part, and averaging the measurement values. The ten-point mean roughness Rz in the circumferential direction may be an average value determined by dividing, in the circumferential direction, the center portion of a charging member in the axial direction into six parts, performing measurement in the center portion of each part, and averaging the measurement values.

The mean spacing of profile irregularities Sm is measured in conformity with JIS B 0601:1994. To determine the mean spacing of profile irregularities Sm, a roughness curve is cut to have the reference distance in a direction in which the mean line thereof extends, the distance of the mean line corresponding to the distance between each peak and the neighboring trough within the roughness curve, which has been cut, is measured, and the arithmetic mean value of the distances is calculated. Sm is expressed in μm. The mean spacing of profile irregularities Sm is measured in an environment of 23° C. and 55% RH by using a contact-type surface roughness tester (SURFCOM 570a, manufactured by Tokyo Seimitsu Co., Ltd.). The measurement distance is 4 mm. The measurement is performed by using a contact needle having a tip made of diamond (5 μmR, 90° cone). The measurement values are averaged. The mean spacing of profile irregularities Sm in the axial direction may be an average value determined by dividing a charging member into six equal parts in the axial direction, performing measurement in the center portion of each part, and averaging the measurement values. The mean spacing of profile irregularities Sm in the circumferential direction may be an average value determined by dividing, in the circumferential direction, the center portion of a charging member in the axial direction into six parts, performing measurement in the center portion of each part, and averaging the measurement values.

The reduced peak height Spk is a parameter that represents the areal surface texture and is defined in ISO 25178-2:2012. Spk is calculated from the three-dimensional surface roughness profile. Spk represents the mean height of peaks above the core portion of the roughness curve of a measured surface. A surface is observed under a laser microscope (VK-X150, manufactured by KEYENCE CORPORATION) including an objective lens with a magnification of 20×, under the conditions in which the measurement size and the measurement pitch are respectively 2048×1536 pixels (0.34 μm/pixel) and 0.75 μm. Then, the whole image is subjected to a curved-surface correction and a three-dimensional measurement to calculate Spk. The reduced peak height Spk is an average value determined by performing measurement at three different positions in the axial direction and averaging the measurement values. The reduced peak height Spk may be an average value determined by dividing a charging member into three equal parts in the axial direction, performing measurement in the center portion of each part, and averaging the measurement values.

In the charging member according to the exemplary embodiment, from the viewpoint of suppressing the generation of image streaks and the wear of the electrophotographic photoconductor surface, when the ratio of Sm to Rz (Sm/Rz) in the circumferential direction is denoted as A and the ratio of Sm to Rz (Sm/Rz) in the axial direction is denoted as B, the ratio of A to B (A/B) preferably satisfies $0.8 \leq A/B \leq 1.2$ and more preferably $0.9 \leq A/B \leq 1.1$.

In the charging member according to the exemplary embodiment, from the viewpoint of suppressing the generation of image streaks and the wear of the electrophotographic photoconductor surface, the ratio of Sm to Spk (Sm/Spk) in the axial direction preferably satisfies $25 \leq Sm/Spk \leq 75$ and more preferably $30 \leq Sm/Spk \leq 60$. Regarding the surface of the surface layer, Sm/Spk represents the ratio of Sm in the axial direction to Spk in the axial direction.

The charging member according to the exemplary embodiment may include roughness-forming particles in the surface layer. The surface layer includes roughness-forming particles, and thus, the charging member that satisfies the range of Sm/Rz, the upper limit of Spk, the range of A/B, and the range of Sm/Spk may be readily produced.

The type and amount of roughness-forming particles, and the forming temperature and the time during formation of each layer may be selected to form a surface layer having an intended roughness and to adjust Sm/Rz ratio, Spk, A/B ratio, and Sm/Spk ratio.

The particle diameter of the roughness-forming particles and the layer thickness of the surface layer may be changed in combination to adjust such properties. Furthermore, such properties may be adjusted, by incorporating the roughness-forming particles into the surface layer to adjust the ten-point mean roughness Rz2 of the elastic layer in the axial direction.

Roughness-Forming Particles

The material of the roughness-forming particles in the surface layer may be any material.

The roughness-forming particles may be inorganic particles or organic particles. Specifically, examples of the roughness-forming particles in the surface layer include inorganic particles, such as silica particles, alumina particles, and zircon ($ZrSiO_4$) particles, and resin particles, such as polyamide particles, fluorine resin particles, and silicone resin particles.

Among such particles, from the viewpoint of suppressing the generation of image streaks, the roughness-forming particles in the surface layer are more preferably resin particles and still more preferably polyamide particles.

The surface layer may include one type or two or more types of the roughness-forming particles.

From the viewpoint of suppressing the generation of image streaks and the wear of the electrophotographic photoconductor surface, the surface layer preferably includes 5 parts by mass or more and 30 parts by mass or less of roughness-forming particles having a volume average particle diameter of 5 μm or more and 20 μm or less relative to 100 parts by mass of a binder resin and more preferably 8 parts by mass or more and 20 parts by mass or less of roughness-forming particles having a volume average particle diameter of 5 μm or more and 10 μm or less relative to 100 parts by mass of a binder resin.

A method for measuring the volume average particle diameter of the particles according to the exemplary embodiment includes observing, under an electron microscope, a sample obtained by cutting the layer, measuring the diameters (maximum diameters) of 100 particles, and volume-averaging the diameters. The average particle diameter may be measured by using Zetasizer Nano ZS manufactured by SYSMEX CORPORATION.

In a case in which the charging member according to the exemplary embodiment includes the roughness-forming particles in the surface layer, the charging member may further include the roughness-forming particles in the elastic layer.

Conductive Substrate

The conductive substrate functions as the electrode and the supporting member of the charging member.

The conductive substrate may be formed of a conductive material. Examples of the conductive material include metals and metal alloys, such as aluminum, a copper alloy, and stainless steel; iron subjected to plating with, for example, chromium or nickel; and conductive resins. The conductive substrate according to the exemplary embodiment functions as the electrode and the supporting member of the charging roller. Examples of the material of the conductive substrate include metals, such as iron (e.g., free-cutting steel), copper, brass, stainless steel, aluminum, and nickel. In the exemplary embodiment, the conductive substrate is a conductive rod-shaped member. Examples of the conductive substrate include members (e.g., resin members and ceramic members) having the plated outer circumferential surface and members (e.g., resin members and ceramic members) in which a conductive agent is dispersed. The conductive substrate may be a hollow member (tube-shaped member) or a non-hollow member.

Elastic Layer

The elastic layer is a conductive layer containing, for example, an elastic material and a conductive agent. The elastic layer may contain another additive if necessary.

The elastic layer may include a single layer or a stack including plural layers stacked on each other. The elastic layer may be a conductive foam elastic layer, a conductive non-foam elastic layer, or a stack of a conducive foam elastic layer and a conductive non-foam elastic layer.

Examples of the elastic material include polyurethane, nitrile rubber, isoprene rubber, butadiene rubber, ethylene-propylene rubber, ethylene-propylene-diene rubber, epichlorohydrin rubber, epichlorohydrin-ethylene oxide rubber, epichlorohydrin-ethylene oxide-allyl glycidyl ether rubber, styrene-butadiene rubber, acrylonitrile-butadiene rubber, chloroprene rubber, chlorinated polyisoprene, hydrogenated polybutadiene, butyl rubber, silicone rubber, fluoro rubber, natural rubber, and elastic materials in which the above materials are mixed together. Among such elastic materials, polyurethane, silicone rubber, nitrile rubber, epichlorohydrin rubber, epichlorohydrin-ethylene oxide rubber, epichlorohydrin-ethylene oxide-allyl glycidyl ether rubber, ethylene-propylene-diene rubber, acrylonitrile-butadiene rubber, and elastic materials in which the above materials are mixed together are preferred.

Examples of the conductive agent include electron-conductive agents and ion-conductive agents.

The electron-conductive agent may be a powder material. Examples of such a powder material include carbon black, such as furnace black, thermal black, channel black, KETJENBLACK, acetylene black, Color Black; pyrolytic carbon; graphite; metals and metal alloys, such as aluminum, copper, nickel, stainless steel; metal oxides, such as tin oxide, indium oxide, titanium oxide, tin oxide-antimony oxide solid solution, tin oxide-indium oxide solid solution; and insulating materials having the surface subjected to conductive treatment.

Examples of the ion-conductive agent include perchloric acid salts and chloric acid salts of tetraethylammonium, lauryltrimethylammonium, or benzyltrialkylammonium; and perchloric acid salts and chloric acid salts of an alkali metal or an alkali earth metal, such as lithium or magnesium.

A single type of conductive agent or two or more types of conductive agents in combination may be used.

The conductive agent particles may have an average primary particle diameter of 1 nm or more and 200 nm or less, for example.

The amount of ion-conductive agent in the elastic layer is preferably 1 parts by mass or more and 30 parts by mass or less and more preferably 15 parts by mass or more and 25 parts by mass or less relative to 100 parts by mass of the elastic material.

The amount of ion-conductive agent in the elastic layer is preferably 0.1 parts by mass or more and 5 parts by mass or less and more preferably 0.5 parts by mass or more and 3 parts by mass or less relative to 100 parts by mass of the elastic material.

The average particle diameter is determined by observing, under an electron microscope, a sample obtained by cutting the elastic layer, measuring the diameters (maximum diameters) of 100 particles of the conductive agent, and volume-averaging the diameters. The average particle diameter may be measured by using Zetasizer Nano ZS manufactured by SYSMEX CORPORATION.

The amount of conductive agent may be any amount; however, when the electron-conductive agent is used, the amount thereof is preferably within the range of 1 parts by mass to 30 parts by mass and more preferably within the range of 15 parts by mass to 25 parts by mass relative to 100 parts by mass of the elastic material. On the other hand, when the ion-conductive agent is used, the amount thereof is preferably within the range of 0.1 parts by mass to 5.0 parts by mass and more preferably within the range of 0.5 parts by mass to 3.0 parts by mass relative to 100 parts by mass of the elastic material.

Examples of another additive added to the elastic layer include softening agents, plasticizers, curing agents, vulcanizing agents, vulcanizing accelerators, vulcanizing accelerating assistants, antioxidants, surfactants, coupling agents, and fillers, such as silica, calcium carbonate, and clay minerals.

The elastic layer preferably has a thickness of 1 mm or more and 10 mm or less and more preferably 2 mm or more and 5 mm or less.

The elastic layer may have a volume resistivity of $1\times10^3$ Ωcm or higher and $1\times10^{14}$ Ωcm or lower.

The volume resistivity of the elastic layer is measured by the following method.

A sheet-shaped measurement sample is collected from the elastic layer. To the measurement sample, a voltage regulated such that the electric field (applied voltage/composition sheet thickness) is 1000 V/cm is applied for 30 seconds in conformity with JIS K 6911 (1995) by using a measurement jig (R12702A/B Resistivity Chamber manufactured by ADVANTEST CORPORATION) and a high resistance measurement machine (R8340A Digital High Resistance/Minute Current Meter manufactured by ADVANTEST CORPORATION), and the current value is measured. Thereafter, the volume resistivity is calculated by the following formula by using the current value.

$$\text{Volume resistivity } (\Omega\text{cm}) = (19.63\times\text{applied voltage } (V))/(\text{current value } (A)\times\text{measurement sample thickness (cm)})$$

From the viewpoint of suppressing the generation of image streaks and the wear of the electrophotographic photoconductor surface, the ten-point mean roughness Rz2 of a surface of the elastic layer that is near the surface layer (i.e., the surface of the elastic layer, without consideration of the presence of the surface layer) in the axial direction preferably satisfies $3\leq Rz2\leq 10$, more preferably $4\leq Rz2\leq 8$, and still more preferably $4\leq Rz2\leq 6$.

To make Rz2 in the above range, the polishing condition of the surface of the elastic layer may be adjusted after the elastic layer is formed on the conductive substrate.

In a method for measuring Rz2, first, the surface layer of the charging member to be used for the measurement is dissolved with an organic solvent (e.g., alcohol solvent, such as methanol) that removes the surface layer, to expose the elastic layer. Next, the ten-point mean roughness Rz of the surface of the exposed elastic layer is measured by a method the same as the above-described method for measuring the ten-point mean roughness Rz.

Examples of a method for forming the elastic layer on the conductive substrate include the following methods: a method that includes extruding, from an extruder, both a cylindrical conductive substrate and an elastic-layer forming composition in which the elastic material, the conductive agent, and another additive are mixed together, to form a layer of the elastic-layer forming composition on the outer circumferential surface of the conductive substrate and heating, thereafter, the layer of the elastic-layer forming composition to cause a crosslinking reaction to form the elastic layer; and a method that includes extruding, from an extruder, an elastic-layer forming composition in which the elastic material, the conductive agent, and another additive are mixed together on the outer circumferential surface of a seamless-belt-shaped conductive substrate to form a layer of the elastic-layer forming composition on the outer circumferential surface of the conductive substrate and heating, thereafter, the layer of the elastic-layer forming composition to cause a crosslinking reaction to form the elastic layer. The conductive substrate may include an adhesive layer on the outer circumferential surface thereof.

Surface Layer

The charging member according to the exemplary embodiment further includes a surface layer on the elastic layer. The surface layer may contain a resin. The surface layer may contain another additive if necessary.

Examples of the binder resin that may be used for the surface layer include urethane, polyester, phenol, acrylic, polyurethane, and epoxy resins- and cellulose.

Typically, conductive particles are included to adjust the resistivity of the surface layer to an appropriate value.

The conductive particles may have a particle diameter of 3 μm or less and a volume resistivity of $10^9$ Ωcm or lower. Examples of the conductive particles include particles of metal oxides, such as tin oxide, titanium oxide, and zinc oxide, alloys of such metal oxides, and carbon black.

The surface layer preferably has a thickness of 2 μm or more and 15 μm or less, more preferably 2 μm or more and 10 μm or less, and still more preferably 3 μm or more and 8 μm or less.

The surface layer may have a volume resistivity of $1\times10^5$ Ωcm or higher and $1\times10^8$ Ωcm or lower.

Examples of a method for applying the surface layer include known methods, such as roller coating, blade coating, wire-bar coating, spray coating, immersion coating, bead coating, air-knife coating, and curtain coating. Roll coating does not cause uneven thickness of the surface layer. Thus, roller coating is preferably used in the exemplary embodiment of the present disclosure, in which the surface layer is thicker at the end portions than at the center portion. Immersion coating causes uneven thickness of the surface layer, but effectively forms a film with fewer flaws. Thus, immersion coating is preferably used.

Adhesive Layer

The charging member according to the exemplary embodiment may include an adhesive layer between the conductive substrate and the elastic layer.

The adhesive layer interposed between the elastic layer and the conductive substrate may be a resin layer. Examples of such a resin layer include polyolefin, acrylic-resin, epoxy-resin, polyurethane, nitrile-rubber, chlorinated-rubber, vinyl chloride-resin, vinyl acetate-resin, polyester, phenol-resin, and silicone-resin layers. The adhesive layer may contain a conductive agent (e.g., the above-described electron-conductive agent or ion-conductive agent).

From the viewpoint of adhesion, the adhesive layer preferably has a thickness of 1 μm or more and 100 μm or less, more preferably 2 μm or more and 50 μm or less, and particularly preferably 5 μm or more and 20 μm or less.

Charging Device, Image Forming Apparatus, and Process Cartridge

A charging device according to the exemplary embodiment includes the charging member according to the exemplary embodiment and charges an electrophotographic photoconductor by a contact charging method.

An image forming apparatus according to the exemplary embodiment may be any image forming apparatus, provided that the charging device according to the exemplary embodiment is included. The image forming apparatus includes an electrophotographic photoconductor and a charging device that includes the charging member according to the exemplary embodiment and that charges the electrophotographic photoconductor by a contact charging method. In other words, the image forming apparatus according to the exemplary embodiment includes an electrophotographic photoconductor, a charging device that includes the charging member according to the exemplary embodiment and that charges the electrophotographic photoconductor by a contact charging method, a latent image forming device that forms a latent image on the surface of the charged electrophotographic photoconductor, a developing device that develops, with a developer containing toner, the latent image formed on the surface of the electrophotographic photoconductor to form a toner image on the surface of the electrophotographic photoconductor, and a transferring device that transfers the toner image formed on the surface of the electrophotographic photoconductor to a recording medium.

The charging device used in the image forming apparatus according to the exemplary embodiment may use a method in which only a direct-current voltage is applied to the charging member (DC charging method), a method in which only an alternative-current voltage is applied to the charging member (AC charging method), or a method in which an alternating-current voltage superimposed on a direct-current voltage is applied to the charging member (AC/DC charging method).

When the charging device uses a method in which an alternative-current voltage is applied (i.e., AC charging method or AC/DC charging method), the amount of discharge to the photoconductor increases compared with that in a DC charging method due to the application of an alternative-current voltage. Thus, a charging device using a method in which an alternative-current voltage is applied is likely to cause the wear of the photoconductor surface. On the other hand, the charging member according to the exemplary embodiment suppresses the generation of image streaks and the wear of the electrophotographic photoconductor surface, as described above. Thus, in a case in which a charging device uses a contact charging method in which an alternative-current voltage is applied, when the charging member according to the exemplary embodiment is used, the generation of image streaks is suppressed and the wear of the electrophotographic photoconductor surface is likely to be suppressed. The wear of a photoconductor surface is often seen in an organic photoconductor including a conductive substrate made of, for example, aluminum and a photosensitive layer that is disposed on the conductive substrate and that contains known materials, such as a binder resin, a charge generation material, and a charge transport material. In a case in which the photoconductor is such an organic photoconductor, when the charging member according to the exemplary embodiment is used, the generation of image streaks is suppressed and the wear of the electrophotographic photoconductor surface is likely to be suppressed.

The image forming apparatus according to the exemplary embodiment may further include at least one selected from a fixing device that fixes a toner image on a recording medium; a cleaning device that cleans the photoconductor surface before charging, after the toner image is transferred; and a discharging device that irradiate the photoconductor surface with light, after the transference of the toner image, to discharge the photoconductor before charging.

The image forming apparatus according to the exemplary embodiment may be one of a direct transfer-type apparatus that directly transfers a toner image formed on the surface of the electrophotographic photoconductor to a recording medium and an intermediate transfer-type apparatus that primarily transfers a toner image formed on the surface of the electrophotographic photoconductor to the surface of an intermediate transfer body and that secondarily transfers the toner image that has been transferred to the surface of the intermediate transfer body to the surface of a recording medium.

A process cartridge according to the exemplary embodiment is detachably attached to the image forming apparatus and includes a charging device that includes the charging member according to the exemplary embodiment and that charges the electrophotographic photoconductor by a contact charging method. In other words, the process cartridge according to the exemplary embodiment includes an electrophotographic photoconductor and a charging device that includes the charging member according to the exemplary embodiment and that charges the electrophotographic photoconductor by a contact charging method. The process cartridge is detachably attached to an image forming apparatus.

The process cartridge according to the exemplary embodiment may further include at least one selected from devices, such as a developing device, a cleaning device for a photoconductor, a discharging device for a photoconductor, and a transferring device.

Hereinafter, with reference to the drawings, structures of the charging device, the image forming apparatus, and the process cartridge according to the exemplary embodiment will be described.

Figure 2:
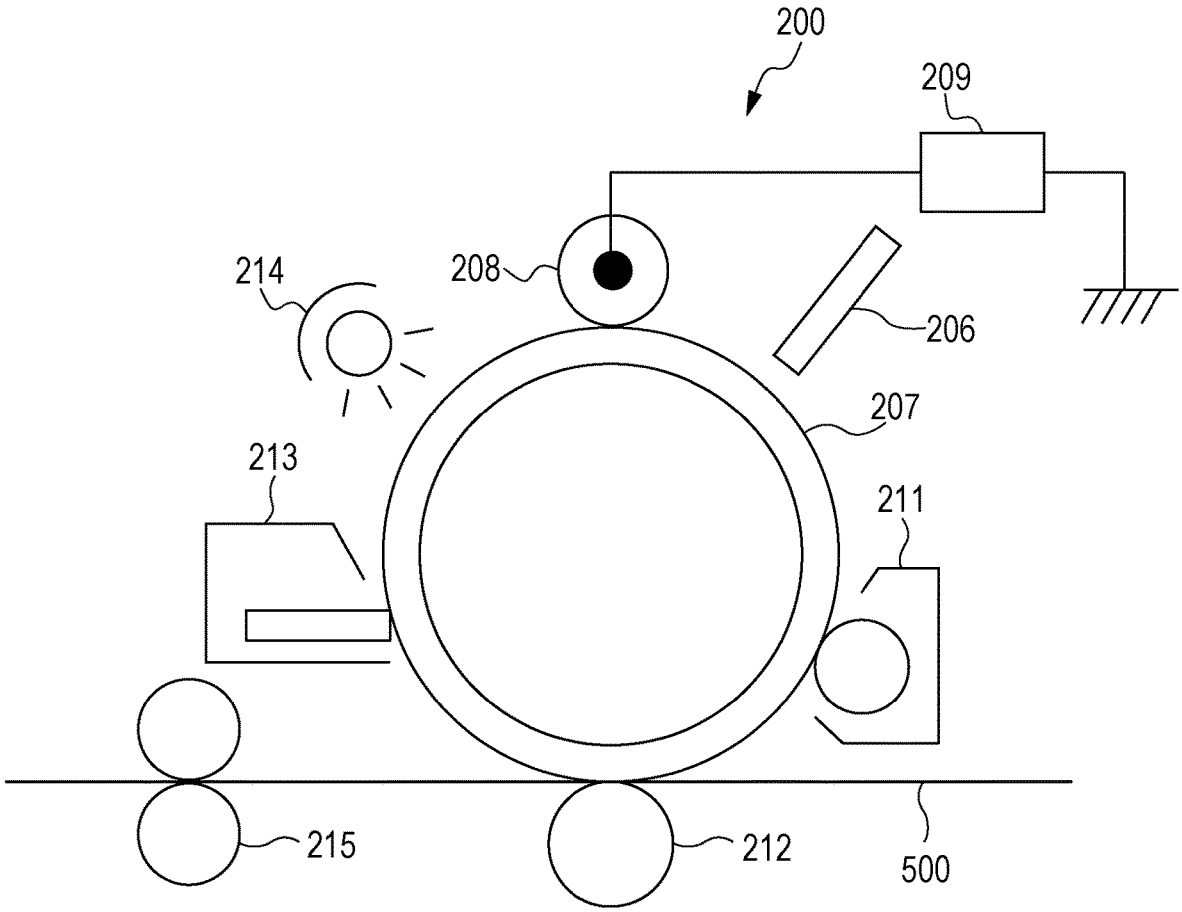
FIG. 2 is a schematic diagram of an exemplary image forming apparatus according to the exemplary embodiment.
Figure 3:
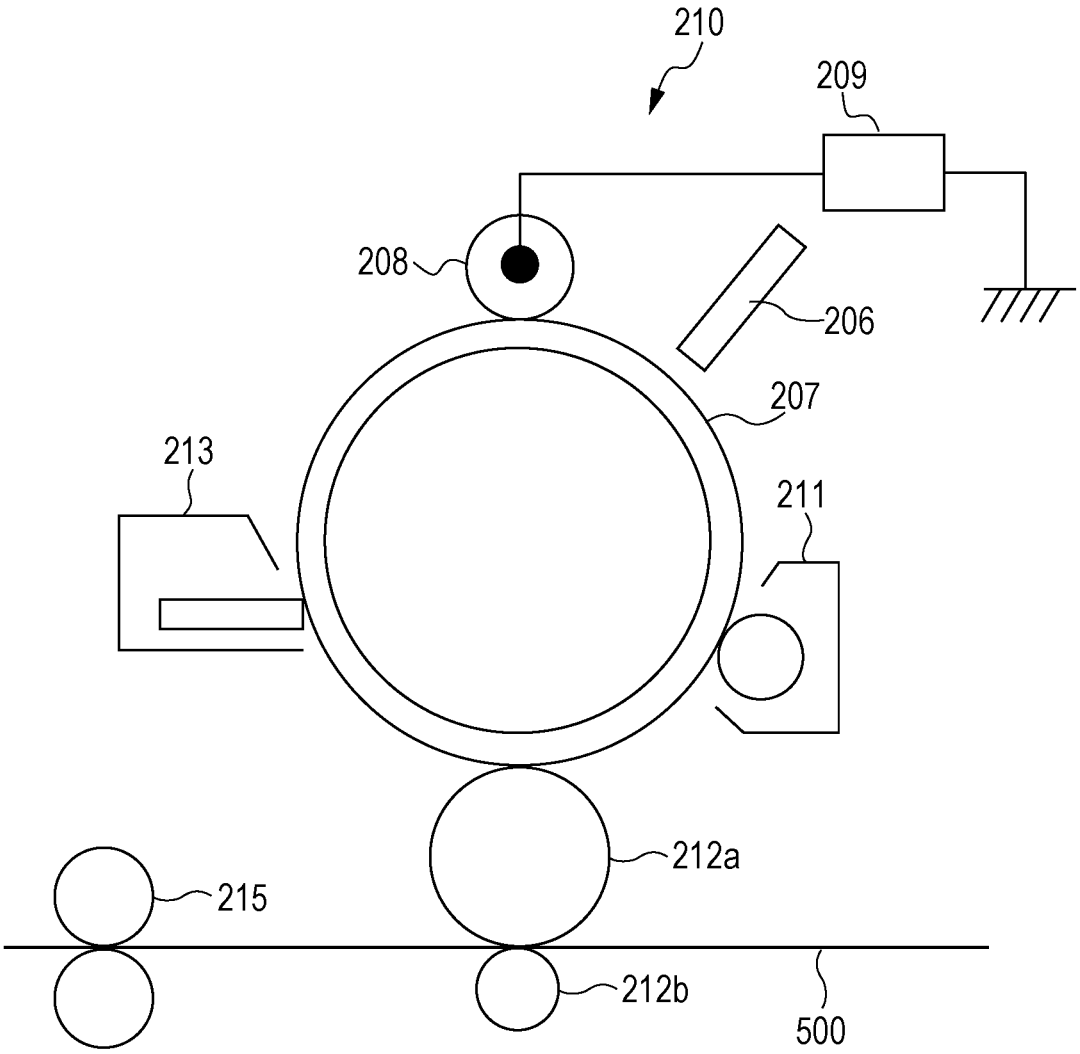
FIG. 3 is a schematic diagram of another exemplary image forming apparatus according to the exemplary embodiment.

FIG. 2 is a schematic diagram of an exemplary image forming apparatus according to the exemplary embodiment. FIG. 2 is a schematic view of a direct transfer-type image forming apparatus. FIG. 3 is a schematic diagram of another exemplary image forming apparatus according to the exemplary embodiment. FIG. 3 is a schematic view of an intermediate transfer-type image forming apparatus.

An image forming apparatus 200 illustrated in FIG. 2 includes an electrophotographic photoconductor (also simply stated as "photoconductor") 207, a charging device 208 that charges the surface of the photoconductor 207, a power source 209 that is connected to the charging device 208, an exposure device 206 that exposes the surface of the photoconductor 207 to form a latent image, a developing device 211 that develops, with a developer containing toner, the latent image on the photoconductor 207, a transferring device 212 that transfers the toner image on the photoconductor 207 to a recording medium 500, a fixing device 215 that fixes the toner image on the recording medium 500, a cleaning device 213 that removes the toner remaining on the photoconductor 207, and a discharging device 214 that discharges the surface of the photoconductor 207. The discharging device 214 is not necessarily included.

An image forming apparatus 210 illustrated in FIG. 3 includes the photoconductor 207, the charging device 208, the power source 209, the exposure device 206, the developing device 211, a first transfer member 212*a* and a second transfer member 212*b* that transfer a toner image on the photoconductor 207 to the recording medium 500, the fixing device 215, and the cleaning device 213. The image forming apparatus 210 may include a discharging device in the same manner as the image forming apparatus 200.

The charging device 208 is a contact-charging-type charging device including a roller-shaped charging member and is in contact with the surface of the photoconductor 207 to charge the surface of the photoconductor 207. To the charging device 208, only a direct-current voltage, only an alternating-current voltage, or an alternating-current voltage superimposed on a direct-current voltage is applied from the power source 209.

The exposure device 206 may be an optical device including a light source, such as a semiconductor laser or a light emitting diode (LED).

The developing device 211 is a device that supplies toner to the photoconductor 207. For example, the developing device 211 moves a roller-shaped developer holder to be in contact with or close to the photoconductor 207 and allows the holder to attach toner to a latent image on the photoconductor 207 to form a toner image.

Examples of the transferring device 212 include a corona-discharge generator and a conductive roller that presses the photoconductor 207 with the recording medium 500 disposed therebetween.

The first transfer member 212*a* may be a conductive roller that is in contact with the photoconductor 207 to rotate. The second transfer member 212*b* may be a conductive roller that presses the first transfer member 212*a* with the recording medium 500 disposed therebetween.

The fixing device 215 may be a heat fixing device including a heating roller and a pressure roller that presses the heating roller.

The cleaning device 213 may be a device including a cleaning member, such as a blade, a brush, or a roller. Examples of the material of the cleaning blade include urethane rubber, neoprene rubber, and silicone rubber.

The discharging device 214 may be a device that irradiates the surface of the photoconductor 207 with light, after transference, to discharge the residual potential of the photoconductor 207. The discharging device 214 is not necessarily included.

Figure 4:
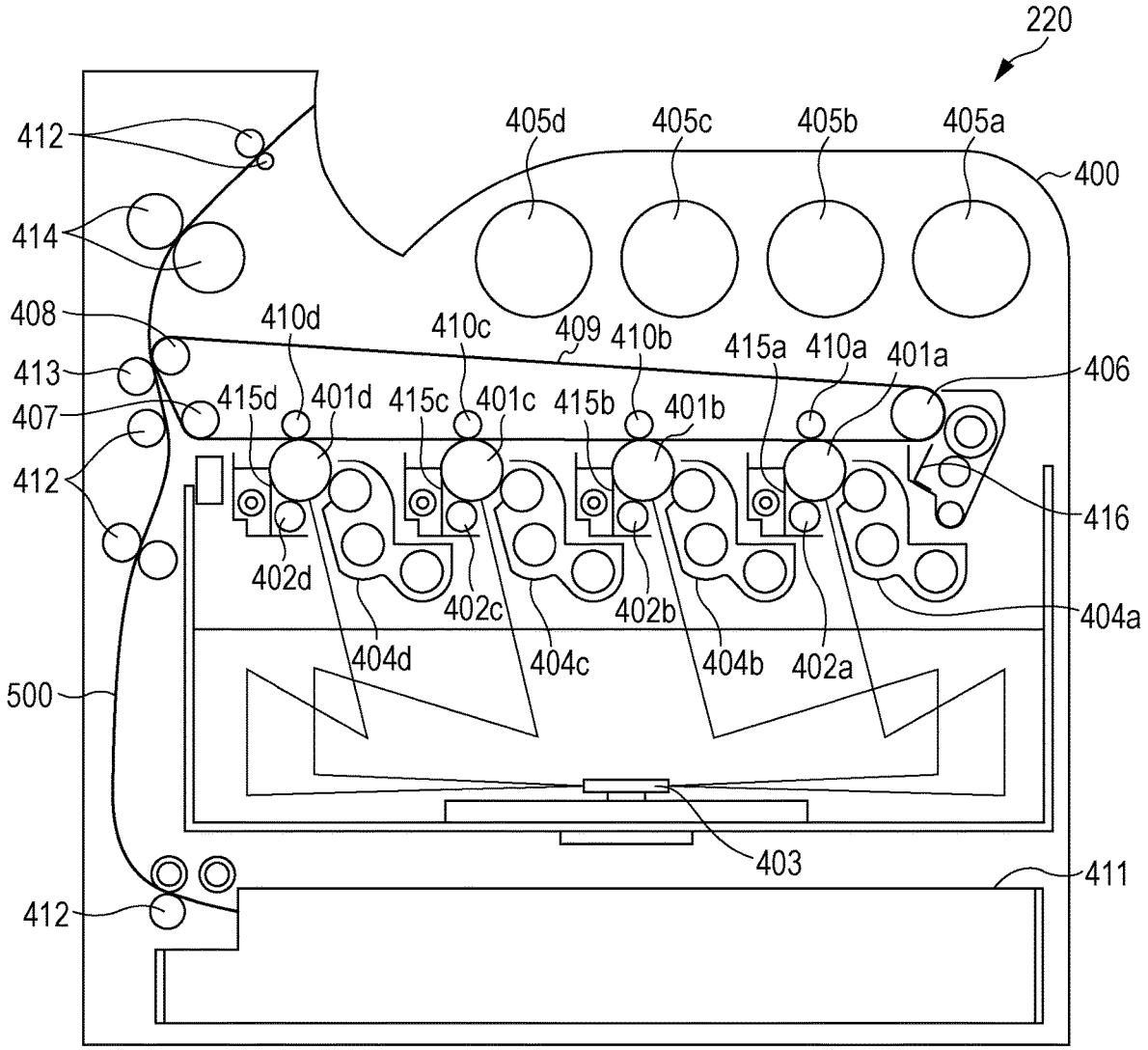
FIG. 4 is a schematic diagram of another exemplary image forming apparatus according to the exemplary embodiment.

FIG. 4 is a schematic diagram of another exemplary image forming apparatus according to the exemplary embodiment. FIG. 4 is a schematic view of a tandem-type and intermediate transfer-type image forming apparatus in which four image forming units are disposed in line.

An image forming apparatus 220 includes, in a housing 400, four image forming units used for different-colored toners, an exposure device 403 including a laser beam source, an intermediate transfer belt 409, a second transfer roller 413, a fixing device 414, and a cleaning device including a cleaning blade 416.

The four image forming units have the same structure. Thus, the structure of the image forming unit including a photoconductor 401*a* will be described as a representative example of all photoconductors 401*a*-401*d*.

Around the photoconductor 401*a*, a charging roller 402*a*, a developing device 404*a*, a first transfer roller 410*a*, and a cleaning blade 415*a* are disposed in this order in the rotational direction of the photoconductor 401*a*. The first transfer roller 410*a* presses the photoconductor 401*a* with the intermediate transfer belt 409 disposed therebetween. Toner placed in a toner cartridge 405*a* is supplied to the developing device 404*a*. These are representative examples of charging rollers 402*a*-402*d*, developing devices 404*a*-404*d*, toner cartridges 405*a*-405*d*, first transfer rollers 410*a*-410*d*, and cleaning blades 415*a*-415*d*.

The charging roller 402*a* is a contact-charging-type charging device that is in contact with the surface of the photoconductor 401*a* to charge the surface of the photoconductor 401*a*. To the charging roller 402*a*, only a direct-current voltage, only an alternating-current voltage, or an alternating-current voltage superimposed on a direct-current voltage is applied from the power source.

The intermediate transfer belt 409 is stretched by a driving roller 406, an stretching roller 407, and a back roller 408 and is moved by rotation of these rollers.

The second transfer roller 413 is disposed so as to press the back roller 408 with the intermediate transfer belt 409 disposed therebetween.

The fixing device 414 may be a heat fixing device including a heating roller and a pressure roller.

The cleaning blade 416 is a member that removes toner that remains on the intermediate transfer belt 409. The cleaning blade 416 is disposed downstream from the back roller 408 and removes toner that remains on the intermediate transfer belt 409 after transference is performed.

A tray 411, which accommodates the recording medium 500, is disposed in the housing 400. The recording medium 500 in the tray 411 is transferred by a transfer roller 412 to the contact portion between the intermediate transfer belt 409 and the second transfer roller 413 and further transferred to the fixing device 414. Then, an image is formed on the recording medium 500. The recording medium 500 is discharged from the housing 400 after the formation of the image on the recording medium.

Figure 5:
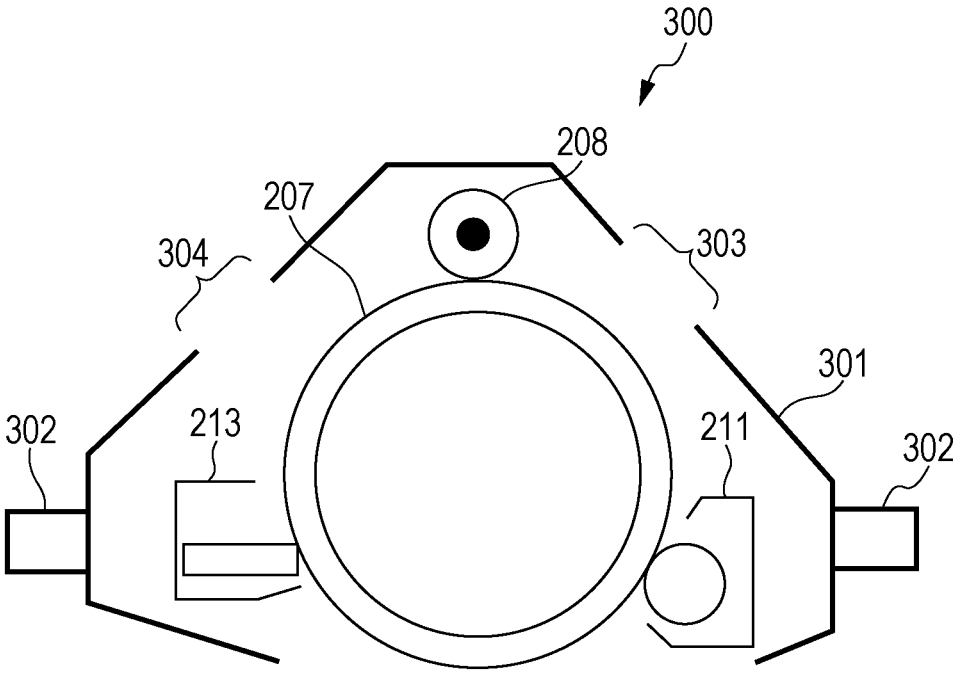
FIG. 5 is a schematic diagram of an exemplary process cartridge according to the exemplary embodiment.

FIG. 5 is a schematic diagram of an exemplary process cartridge according to the exemplary embodiment. A process cartridge 300 illustrated in FIG. 5 is detachably attached to the main body of an image forming apparatus including, for example, an exposure device, a transferring device, and a fixing device.

The process cartridge 300 is formed by integrating the photoconductor 207, the charging device 208, the developing device 211, and the cleaning device 213 in a housing 301. The housing 301 includes an attachment rail 302 used for detachably attaching the housing 301 to an image forming apparatus, an opening 303 for exposure, and an opening 304 for discharging exposure.

The charging device 208 included in the process cartridge 300 is a contact-charging-type charging device including a roller-shaped charging member and is in contact with the surface of the photoconductor 207 to charge the surface of the photoconductor 207. When the process cartridge 300 is attached to an image forming apparatus to form an image, only a direct-current voltage, only an alternating-current voltage, or an alternating-current voltage superimposed on a direct-current voltage is applied from the power source to the charging device 208.

Developer, Toner

A developer used in the image forming apparatus according to the exemplary embodiment is any developer. The developer may be a one-constituent developer containing only toner or a two-constituent developer in which toner and a carrier are mixed together.

Toner contained in the developer may be any toner. The toner may include a binder resin, a colorant, and a releasing agent. Examples of the binder resin in the toner include polyesters and styrene-acrylic resins.

An external additive may be externally added to the toner. The external additive in the toner may be an inorganic particle, such as a silica particle, a titania particle, or an alumina particle.

The toner is prepared by producing toner particles and externally adding an external additive to the toner particles. Examples of a method for producing the toner particles include a kneading-milling method, an aggregation-coalescence method, a suspension-polymerization method, and a dissolution-suspension method. The toner particles may each have a monolayer structure or a so-called core-shell structure including a core portion (core particle) and a covering layer (shell layer) that covers the core portion.

The toner particles preferably have a volume average particle diameter (D50v) of 2 μm or more and 10 μm or less and more preferably 4 μm or more and 8 μm or less.

A carrier contained in a two-constituent developer is any carrier. Examples of such a carrier include a covered carrier having a core material that is formed of a magnetic powder and that has the surface covered with a resin; a magnetic powder-dispersed-type carrier containing a matrix resin in which magnetic powders are dispersed and mixed together; and a resin-impregnated-type carrier containing porous magnetic powders impregnated with a resin.

In the two-constituent developer, the mixing ratio (mass ratio) of the toner to the carrier (toner/carrier) is preferably 1:100 to 30:100 and more preferably 3:100 to 20:100.

EXAMPLES

Hereinafter, the exemplary embodiment of the disclosure will be described in detail with reference to Examples. The exemplary embodiment of the disclosure is not limited to Examples. In the following description, the unit "part" is based on mass, unless stated otherwise.

Example 1

Production of Charging Member

Preparation of Conductive Substrate

A substrate formed of SUM23L is subjected to electroless nickel plating for forming a nickel-plating layer with a thickness of 5 μm and is treated with hexavalent chromium acid to obtain a conductive substrate having a diameter of 8 mm.

Formation of Adhesive Layer

Next, the following mixture is mixed by using a ball mill for an hour. Then, the mixture is applied to the surface of the conductive substrate by brushing to form an adhesive layer having a layer thickness of 10 μm.

chlorinated polypropylene resin (maleic anhydride-modified chlorinated polypropylene resin, SUPERCHLON 930, manufactured by Nippon Paper Industries CO., LTD.): 100 parts epoxy resin (EP4000, manufactured by ADEKA Corporation): 10 parts conductive agent (carbon black, KETJENBLACK EC, manufactured by Ketjen Black International Company): 2.5 parts Toluene or xylene is used to adjust the viscosity.

Formation of Elastic Layer epichlorohydrin rubber (Hydrin® T3106, manufactured by Zeon Corporation): 100 parts by mass carbon black (Asahi #60, manufactured by Asahi Carbon Co., Ltd.): 6 parts by mass calcium carbonate (WHITON SB, manufactured by SHIRAISHI CALCIUM KAISHA, LTD.): 20 parts by mass ion-conductive agent (BTEAC, manufactured by Lion Corporation): 5 parts by mass vulcanizing accelerator: stearic acid (manufactured by NOF CORPORATION): 1 part by mass vulcanizing agent: sulfur (VULNOC R, manufactured by OUCHI SHINKO CHEMICAL INDUSTRIAL CO., LTD.): 1 part by mass vulcanizing accelerator: zinc oxide: 1.5 parts by mass The mixture having the above composition is kneaded by using a tangential-type pressure kneader and passed through a strainer to prepare a rubber composition. The obtained rubber composition is kneaded by using an open-roll mill. The mixture is applied by using an extrusion molding machine to the surface of the prepared conductive substrate, with an adhesive layer disposed between the surface and the rubber composition, to form a roller having a diameter of 12 mm and is then heated at 175° C. for 70 minutes to obtain a roll-shaped elastic layer. Next, the obtained elastic layer is polished such that the ten-point mean roughness Rz2 in the axial direction is a value in Table 1.

Formation of Surface Layer binder resin: N-methoxymethylated nylon 1 (product name: FR101, manufactured by Namariichi Co., Ltd.): 100 parts by mass conductive agent: carbon black (volume average particle diameter: 43 nm, product name: MONAHRCH 1000, manufactured by Cabot Corporation): 15 parts by mass roughness-forming particles: polyamide particles (volume average particle diameter: 10 μm, product name: Orgasol 2001 EXD Nat 1, manufactured by ARKEMA K.K.): 12 parts by mass The mixture having the above composition is diluted with methanol and dispersed by using a beads mill under the following conditions.

bead material: glass bead diameter: 1.3 mm number of propeller rotations: 2,000 rpm dispersion time: 60 min The dispersion liquid obtained as described above is applied to the surface of the elastic layer by blade coating, heat-dried at 150° C. for 30 minutes to form a surface layer having a layer thickness of 10 μm, thereby obtaining a charging roller in Example 1.

Examples 2 to 9

A charging roller in each Example is obtained in the same manner as in Example 1, except that the amount of roughness-forming particles is changed in accordance with Table 1.

Example 10

A charging roller in Example 10 is obtained in the same manner as in Example 1, except that polyamide particles (volume average particle diameter: 20 μm, product name: Orgasol 2002 D Nat 1, manufactured by ARKEMA K.K.) are used as the roughness-forming particles, that the amount of particles is 6 parts, and that the layer thickness is 15 μm.

Examples 11, 12

A charging roller in each Example is obtained in the same manner as in Example 10, except that the amount of roughness-forming particles is changed in accordance with Table 1.

Example 13

A charging roller in Example 13 is obtained in the same manner as in Example 1, except that $SiO_2$ particles (volume average particle diameter 12 μm, SUNSPHERE H121, manufactured by AGC SI-TECH CO., LTD.) are used instead of the polyamide particles and that the amount of $SiO_2$ particles is 10 parts by mass.

Comparative Example 1

A charging roller in Comparative Example 1 is obtained in the same manner as in Example 10, except that the amount of roughness-forming particles is 10 parts.

Comparative Examples 2, 3

A charging roller in each Comparative Example is obtained in the same manner as in Example 1, except that polyamide particles (volume average particle diameter: 5 μm, product name: Orgasol 2001 UD Nat 1, manufactured by ARKEMA K.K.) are used as the roughness-forming particles and that the amount of polyamide particles is a value in Table 1.

Comparative Examples 4, 5

A charging roller in each Comparative Example is obtained in the same manner as in Example 1, except that Rz2 of the elastic layer in the axial direction is changed in accordance with Table 1.

Surface Texture of Surface Layer and Elastic Layer

The ten-point mean roughness Rz, mean spacing of profile irregularities Sm, and reduced peak height Spk of the surface layer in the axial direction, the ten-point mean roughness Rz and mean spacing of profile irregularities Sm of the surface layer in the circumferential direction, and Rz2 of the elastic layer in the axial direction are measured by the above-described methods, and Sm/Rz, Sm/Spk, and A/B are calculated.

Evaluation of Image Streaks

A charging roller obtained in each of the above Examples and Comparative Examples is incorporated in a modified version of an image forming apparatus (DocuCentre-V C7776). Under a condition of low temperature and low humidity (10° C., 15% RH), an A4 halftone image with an area coverage of 20% is output to 200,000 sheets. Then, a halftone image with an area coverage of 60% is output to a single sheet. Image streaks, which are caused by the contamination of the charging roller, in the output halftone image with an area coverage of 60% are evaluated with grades G0 to G4. There is no problem in use with G0 to G3.

Evaluation of Wear of Photoconductor Surface

After image streaks are evaluated, the film thickness of the photoconductor is measured by using an eddy-current film thickness gauge (FISCHER SCOPE MMS). The amount of wear of the layer thickness is divided by the number of photoconductor rotations to calculate the rate of the wear. The lower the rate of the wear, the less the wear.

TABLE 1

| | Surface layer | | | | | | | | | | | Evaluation | |
|---|---|---|---|---|---|---|---|---|---|---|---|---|---|
| | Roughness-forming particles | | | | Axial direction | | | | | A in circumferential direction/B in axial direction | Elastic layer Rz2 μm | Image streaks | Photoconductor Rate of wear (nm/kcyc) |
| | Type | Particle diameter μm | Parts Parts by mass | Layer thickness μm | Rz μm | Sm μm | Sm/Rz | Spk μm | Sm/Spk | | | | |
| Example 1 | PA particles | 10 | 12 | 10 | 5.3 | 124.5 | 23.5 | 3.1 | 40.2 | 1.05 | 5.1 | G2 | 22.3 |
| Example 2 | PA particles | 10 | 13 | 10 | 5.6 | 112.9 | 20.2 | 3.2 | 35.3 | 1.02 | 5.3 | G2 | 22.3 |
| Example 3 | PA particles | 10 | 11 | 10 | 4.7 | 138.9 | 29.6 | 2.7 | 51.4 | 0.98 | 5.4 | G2 | 22.4 |
| Example 4 | PA particles | 10 | 15 | 10 | 5.9 | 90.9 | 15.4 | 3.4 | 26.7 | 0.91 | 5.2 | G3 | 22.4 |
| Example 5 | PA particles | 10 | 10 | 10 | 4.4 | 149.0 | 33.9 | 2.5 | 59.6 | 1.08 | 5.5 | G3 | 22.1 |
| Example 6 | PA particles | 10 | 9 | 10 | 4.3 | 145.9 | 33.9 | 2.7 | 54.0 | 1.12 | 5.3 | G3 | 22.4 |
| Example 7 | PA particles | 10 | 8 | 10 | 4.5 | 153.0 | 34.0 | 3.1 | 49.4 | 0.89 | 6.1 | G3 | 22.4 |
| Example 8 | PA particles | 10 | 16 | 10 | 5.9 | 90.7 | 15.4 | 3.5 | 25.9 | 1.04 | 4.9 | G3 | 22.5 |
| Example 9 | PA particles | 10 | 14 | 10 | 5.8 | 90.2 | 15.6 | 3.6 | 25.1 | 0.94 | 5.3 | G3 | 22.7 |
| Example 10 | PA particles | 20 | 6 | 15 | 7.1 | 187.8 | 26.5 | 4.9 | 38.3 | 1.04 | 5.0 | G2 | 23.6 |
| Example 11 | PA particles | 20 | 7 | 15 | 8.1 | 179.3 | 22.1 | 4.6 | 39.0 | 0.81 | 9.3 | G2 | 23.2 |
| Example 12 | PA particles | 20 | 5 | 15 | 7.1 | 183.2 | 25.8 | 4.6 | 39.8 | 1.19 | 3.4 | G2 | 23.4 |
| Example 13 | $SiO_2$ particles | 12 | 10 | 10 | 5.1 | 118.9 | 23.3 | 3.0 | 39.6 | 1.01 | 5.1 | G2 | 22.3 |
| Comparative Example 1 | PA particles | 20 | 10 | 15 | 6.6 | 149.6 | 22.7 | 5.2 | 28.8 | 1.01 | 5.4 | G2 | 24.7 |
| Comparative Example 2 | PA particles | 5 | 10 | 10 | 2.9 | 124.3 | 42.9 | 1.5 | 82.9 | 0.99 | 5.2 | G4 | 21.3 |
| Comparative Example 3 | PA particles | 5 | 40 | 10 | 7.7 | 93.6 | 12.2 | 4.4 | 21.3 | 1.03 | 5.3 | G4 | 23.5 |
| Comparative Example 4 | PA particles | 10 | 12 | 10 | 3.2 | 129.4 | 40.4 | 2.0 | 64.7 | 0.78 | 12.5 | G4 | 21.7 |
| Comparative Example 5 | PA particles | 10 | 12 | 10 | 7.6 | 95.2 | 12.5 | 4.5 | 21.2 | 1.22 | 2.1 | G4 | 23.5 |

"A in circumferential direction/B in axial direction" in Table 1 refers to the ratio of ratio A (Sm/Rz) in the circumferential direction to ratio B (Sm/Rz) in the axial direction (A/B).

"PA particles" in Table 1 refers to polyamide particles.

From the above evaluation results, it has been found that Examples are better than Comparative Examples in the evaluation of image streaks and the evaluation of the wear of the photoconductor surface.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A charging member comprising:

a conductive substrate;

an elastic layer disposed on the conductive substrate; and a surface layer disposed on the elastic layer, wherein, regarding a surface of the surface layer, in an axial direction, a ratio of a mean spacing of profile irregularities Sm to a ten-point mean roughness Rz and a reduced peak height Spk respectively satisfy 15≤Sm/Rz≤35 and Spk≤5 μm, wherein, the reduced peak height Spk satisfies Spk≤3.5 μm.

2. The charging member according to claim 1, wherein the ratio of the Sm to the Rz satisfies 20≤Sm/Rz≤30.

3. The charging member according to claim 1, wherein the reduced peak height Spk satisfies Spk≤4 μm.

4. The charging member according to claim 1, wherein a ratio of the Sm to the Spk in the axial direction satisfies 25≤Sm/Spk≤75.

5. A charging device comprising the charging member according to claim 1, wherein the charging device charges an electrophotographic photoconductor by a contact charging method.

6. A process cartridge comprising:

an electrophotographic photoconductor; and a charging device that includes the charging member according to claim 1 and that charges the electrophotographic photoconductor by a contact charging method, wherein the process cartridge is detachably attached to an image forming apparatus.

7. An image forming apparatus comprising:

an electrophotographic photoconductor;

a charging device that includes the charging member according to claim 1 and that charges the electrophotographic photoconductor by a contact charging method;

a latent image forming device that forms a latent image on a surface of the charged electrophotographic photoconductor;

a developing device that develops, with a developer containing toner, the latent image formed on the surface of the electrophotographic photoconductor to form a toner image on the surface of the electrophotographic photoconductor; and a transferring device that transfers the toner image formed on the surface of the electrophotographic photoconductor to a recording medium.

8. A charging member comprising:

a conductive substrate;

an elastic layer disposed on the conductive substrate; and a surface layer disposed on the elastic layer, wherein, regarding a surface of the surface layer, in an axial direction, a ratio of a mean spacing of profile irregularities Sm to a ten-point mean roughness Rz and a reduced peak height Spk respectively satisfy $15 \leq Sm/Rz \leq 35$ and $Spk \leq 5$ μm, when a ratio of a mean spacing of profile irregularities Sm to a ten-point mean roughness Rz (Sm/Rz) in a circumferential direction is denoted as A and the ratio of the Sm to the Rz (Sm/Rz) in the axial direction is denoted as B, a ratio of the A to the B satisfies $0.8 \leq A/B \leq 1.2$.

9. The charging member according to claim 8, wherein the A/B satisfies $0.9 \leq A/B \leq 1.1$.

10. A charging member comprising:

a conductive substrate;

an elastic layer disposed on the conductive substrate; and a surface layer disposed on the elastic layer, wherein, regarding a surface of the surface layer, in an axial direction, a ratio of a mean spacing of profile irregularities Sm to a ten-point mean roughness Rz and a reduced peak height Spk respectively satisfy $15 \leq Sm/Rz \leq 35$ and $Spk \leq 5$ μm, wherein a ten-point mean roughness Rz2 of a surface of the elastic layer that is near the surface layer in the axial direction satisfies $3 \leq Rz2 \leq 10$.

* * * * *